United States Patent [19]

Schosek

[11] 4,455,107

[45] Jun. 19, 1984

[54] PIPE AND CABLE INSTALLERS

[75] Inventor: William O. Schosek, North Fort Myers, Fla.

[73] Assignee: Elephant Industries, Inc., North Fort Myers, Fla.

[21] Appl. No.: 394,621

[22] Filed: Jul. 2, 1982

[51] Int. Cl.[3] ..... E21B 9/00

[52] U.S. Cl. ..... 405/184; 175/62; 254/29 R; 405/154

[58] Field of Search ..... 405/184, 154; 175/62, 175/53, 72; 254/29 R

[56] References Cited

U.S. PATENT DOCUMENTS

| | | | |
|---|---|---|---|
| 3,834,668 | 9/1974 | Casey | 254/29 R |
| 3,988,003 | 10/1976 | Schosek | 254/29 R |
| 3,998,428 | 12/1976 | Miles | 254/29 R |
| 4,251,058 | 2/1981 | Schosek | 254/29 R |
| 4,274,758 | 6/1981 | Schosek | 175/62 X |

*Primary Examiner*—Dennis L. Taylor
*Attorney, Agent, or Firm*—Alfred E. Wilson

[57] ABSTRACT

To install a pipe or cable in the ground without disturbing the surface or the ground above the pipe or cable such for example as where a pipe is to be installed under a street, driveway or sidewalk, it is customary to place an underground pipe installing device in an operating trench on one side of where the pipe is to be installed, and to force a solid installation rod through the ground to a target trench on the opposite side. The pipe or cable to be installed is then connected to the installation rod, and the rod is withdrawn to install the pipe or cable in the hole made by the rod.

To drive the rod through the ground it is customary to grip or clamp the rod firmly on opposite sides, with a sufficient pressure to force the rod through the ground when an axially directed force is exerted on it. To avoid exerting bending forces on the rod it is desirable that the rod be gripped firmly at locations precisely opposite each other, and that sufficient radial clamping forces be exerted on the rod to prevent the jaws from slipping longitudinally on the rod. The installation rod is thus firmly clamped between the jaws, and the rod is then moved longitudinally by force exerted through the jaws to force it through the ground toward the target trench.

6 Claims, 6 Drawing Figures

PIPE AND CABLE INSTALLERS

BACKGROUND OF THE PRESENT INVENTION

Various types of rod gripping and driving jaws have heretofore been used in an effort to exert a sufficient gripping force on the installation rod to force the rod through the ground preporatory to installing a pipe or cable in the ground. Some of the rod gripping jaws heretofore used exerted radial inward pressure at points spaced somewhat longitudinally of the rod, and thus exerted a bending movement which would flex the rod to deflect the rod from its desired path and introduce destructive forces in the rod. Some of the gripping jaws heretofore used exerted spaced apart up and down or reversely spaced bending forces on the rods where it was contempleated that the forces would balance out over a short length of the rod, but such systems imposed undesirable loads on the rods which introduced internal destruction stresses, and caused the rods to bend.

In the use of an underground pipe installing device it is customary that the pipe installer be placed in an operating trench. To minimize the necessity for digging up the ground it is desirable that the pipe installing mechanism be as narrow as possible to avoid digging a wide operating trench which would disrupt the ground to an undesirable degree. The rod gripping jaws and jaw actuating mechanisms heretofore employed have been relatively wide, and therefore have necessitated the use of wide operating trenches to receive the apparatus required to exert sufficient force to drive the operating rod through the ground.

OBJECTS OF THE PRESENT INVENTION

An object of this invention is to provide installation rod gripping jaws designed to engage the rod precisely on opposite sides, and to exert a gripping force thereon proportionate to the force exerted through the jaws to the rod and required to move the rod through the earth to avoid the possibility of the jaws slipping on the rod.

Another object of this invention is to provide two gripping jaws adapted to engage an installation rod precisely on opposite sides, and wherein fluid pressure actuated force applying means are exerted through the jaws to increase the rod gripping force in proportion to the force required to drive the rod through the earth, and therefore is proportion to the density of the earth through which the rod is being driven.

A still further object is to provide a narrow installation actuating mechanism wherein vertically spaced rod gripping jaw actuating hydraulic cylinders are provided to permit the development of a narrow rod installing unit adapted to be received in a narrow operating trench thereby minimizing the necessary width of the operating trench for an underground pipe installing mechanism.

Another object is to provide a rugged and strong lightweight rod installing unit adapted to be installed in a narrow operating trench.

Other objects and advantages of this invention will appear in the following detailed description and in the accompanying drawings.

DETAILED DESCRIPTION OF A PREFERRED EMBODIMENT

Figure 2:
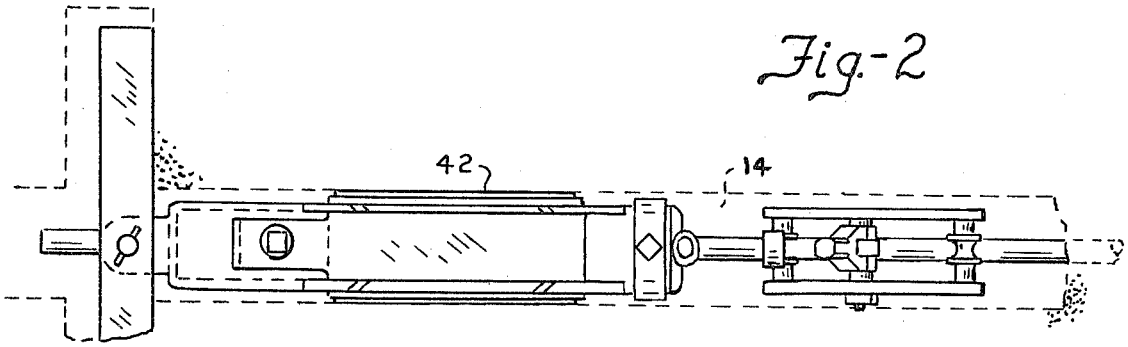
FIG. 2 is a top plan view of the device of FIG. 1.
Figure 1:
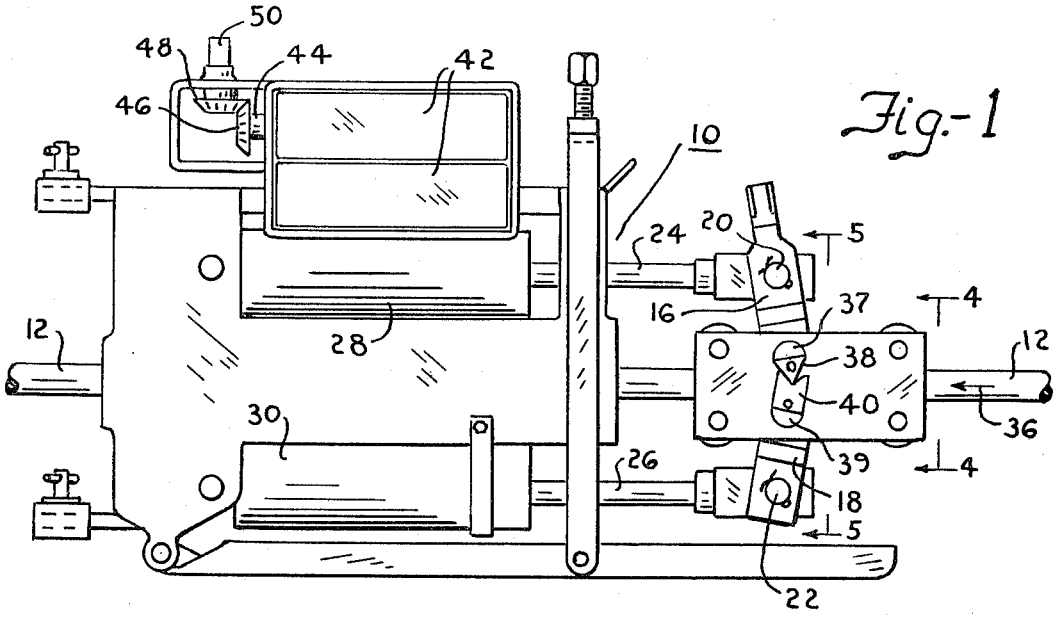
FIG. 1 is a side elevational view of an installation rod gripping and actuating device.

Referring now more particulary to FIG. 1 an underground pipe installing device 10 is provided to exert an axially directed force on an installation rod 12. The rod 12 may be formed of a plurality of relatively short sections, such for example as three foot long sections adapted to be secured together as disclosed in my U.S. Pat. No. 4,309,122 issued Jan. 5, 1982. This availability of forming a relatively long installation rod by connecting up a plurality of short rods renders it possible to install the pipe installing device 10 in a relatively short operating trench.

The installation rod 12 is supported in spaced pairs of rollers 13 and 15 on opposite sides of the upper and lower jaws 16 and 18 by which the rod is gripped and forced to move in the direction of the arrows 36. The jaws 16 and 18 are pivotally mounted at 20 and 22 respectively in upper and lower piston rods 24 and 26 projecting into their associated upper and lower cylinders 28 and 30, and having pistons slidably mounted in the cylinders. The upper and lower cylinders 28 and 30 are each of the same diameters, and the pistons in the cylinders 28 and 30 and rods 24 and 26 fixed to the pistons in the cylinders 28 and 30 are of equal diameters respectively so that the pistons slidably mounted in the cylinders 28 and 30 will exert substantially equal axial forces on the upper and lower rods 24 and 26 by which the jaws 16 and 18 are driven.

The upper and lower rod gripping jaws 16 and 18 are of the same lengths, and the installation rod gripping jaws 16 and 18 each have central sections which do not engage the installation rod 12 when the jaws 16 and 18 are perpendicular to the installation rod 12. The jaws 16 and 18 each have forward and trailing bevelled edges 32 and 34 on opposite sides of the central portions so that the bevelled edges 32 engage and grip the rod 12 on the left side thereof when the upper and lower piston rods 24 and 26 are moved toward the left as viewed in FIGS. 1 and 3 to move the installation rod 12 toward the left in the direction of the arrow 36 as illustrated in FIGS. 1 and 3.

Figure 6:
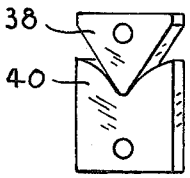
FIG. 6 is a side elevational view of a motion transmitting device to insure that the jaws and cylinders move in unison.
Figure 4:
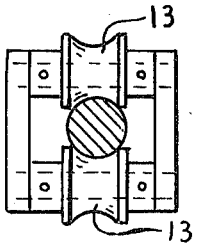
FIG. 4 is a sectional view taken substantially on the line 4—4 of FIG. 1, looking in the direction of the arrows, and showing the guide rollers.
Figure 5:
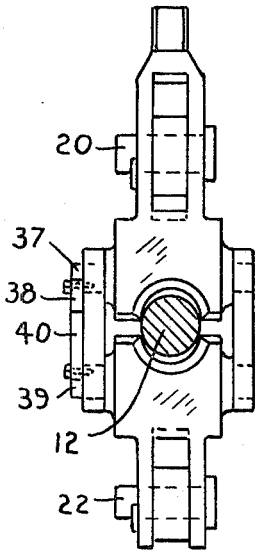
FIG. 5 is a sectional view taken on the line 5—5 of FIG. 1, looking in the direction of the arrows.

It is desirable that the radial pressure exerted on the installation rod 12 by the upper and lower jaws 16 and 18 be the same so as to grip the rod 12 with equal pressure on both sides of the rod and to move the rod 12 longitudinally toward the left. Since the cylinders, pistons and piston rods respectively are the same in diameter, and the radial lengths of the jaws 16 and 18 from their pivots 20 and 22 to the points of contact with the rod 12 are the same, the pressure exerted on opposite sides of the rod 12 are substantially the same. To insure that precise equal pressures are exerted by the jaws on opposite sides of the rod 12 I have found it desirable to provide motion transmitting means between the jaws 16 and 18 to insure that they move precisely in unison. This motion transmitting means may be in the form of pivots 37 and 39 adjacent the points of contact of the jaws 16 and 18 as illustrated in FIGS. 1 and 6 wherein motion transmitting devices 38 and 40 in the form of a one toothed gear carried by the pivots 37 and 39 are provided to insure equal movement of the jaws to induce them to grip the rod 12 with equal force on opposite sides. This eliminates the need for a flow divider to control the flow of fluid under pressure to the cylinders 28 and 30.

Figure 3:
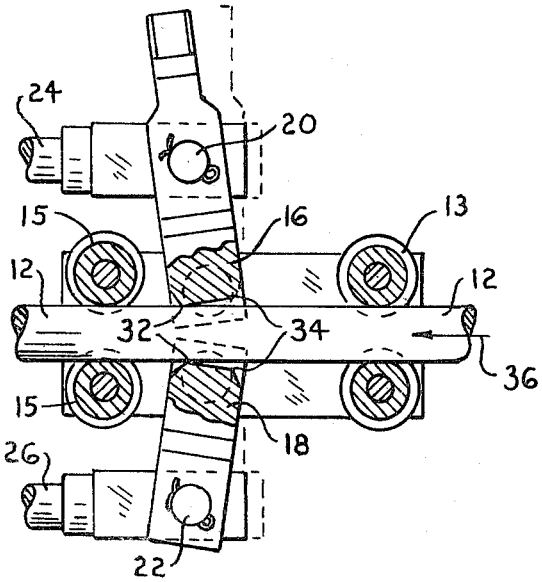
FIG. 3 is a sectional view of the rod gripping and actuating mechanism of FIG. 1.

The forward bevelled edge 32 of the upper jaw 16 is pivoted in the counterclockwise direction as the upper piston rod 24 is move toward the left as viewed in FIGS. 1 and 3. Likewise the forward bevelled edge 32 of the lower jaw 18 is pivoted in the clockwise direction as the lower piston rod 26 is moved toward the left as viewed in FIGS. 1 and 3. THe jaws 16 and 18 exert sufficient radial force inward on the rod 12 to firmly hold the rod 12, and to move it axially to the left as the piston rods 24 and 26 move toward the left in the cylinders 28 and 30.

By directing the force required to move the installation rod 12 and exerting that force through the hydraulic system including the cylinders 28 and 30, assurance is had that sufficient radial clamping force is exerted on the rod 12 to prevent slippage of the rod 12 in the jaws. This is because the greater the lateral force that is required move the rod 12 in the earth, the greater is the inward radial force exerted by the jaws 32 on the rod 12.

When the rod 12 has been moved to the extent of the travel of the piston rods 24 and 26 to the left in the cylinders 28 and 30 the pistons and rods are shifted toward the right as viewed in FIGS. 1 and 3. As the jaws 16 and 18 move to the perpendicular position relative to the rod 12 they slide to the right on the rod, and when they reach the extremity of movement toward the right and start to move toward the left, the jaws 16 and 18 start to move angularly bringing the bevelled edges 32 of the jaws in contact with the rod 12 whereupon rod 12 is engaged and is carried toward the left through the earth.

When the rod 12 has moved to the left to the full extent desired, and the end of the rod 12 emerges into the target trench on the other side of the area through which it is desired to install an underground pipe, that phase of the operation is then completed. The cap is then removed from the rod 12, and the pipe to be installed in the hole made by the rod 12 is attached to the end of the rod 12 through the suitable connector such as that shown in U.S. Pat. No. 4,318,539 issued Mar. 9, 1982.

The jaw actuating mechanism is then operated to reverse the direction of the jaws whereupon the trailing bevelled edges 34 on the opposite or right hand side of the jaws 16 and 18 as viewed in FIG. 3 engage the rod 12 to move it in the opposite direction, that is to the right as viewed in FIGS. 1 and 3 to withdraw the rod 12 and pull the pipe to be installed into the hole made by the rod 12.

The underground pipe installer disclosed herein is particularly desirable because it is very narrow and only required an operating trench approximately 6 inches wide. That is because the jaw operating sylinders 28 and 30 which also move the rod 12 through the earth are positioned vertically, one above the other on opposite sides of the rod 12. Stabilizing gates 42 are preferably positioned above the jaw actuating cylinders 28 and 30. The stabilizing gates 42 are actuated by a horizontal shaft 44 having a bevel gear 46 which meshes with another bevel gear 48 actuated by a stub shaft 50 which may be engaged by a hand operated crank having a crossarm to enable an operator to exert sufficient force thereon to empand the stabilizing gates 42 into firm engagement with the vertical walls of the operating trench 14 to securely hold the device in the operating trench.

I claim:

1. An underground pipe installing device comprising an installation rod adapted to be projected underground from an operating trench, a pair of diametrically opposed rod driving jaws pivotally mounted transversely of the installation rod and having central radial lengths from the pivotal mounting of the jaws to the position perpendicular to the rod proportioned to disengage the installation rod when the jaws are substantially perpendicular to the installation rod, the opposite sides of the driving jaws having longer radial lengths to engage the installation rod when the driving jaws are pivoted in opposite directions from the central perpendicular position relative to the installation rod, a source of fluid pressure, and fluid pressure operated means to actuate the jaws to engage the installation rod and to exert an axially directed force through the jaws to move the installation rod.

2. The invention defined in claim 1 wherein the installation rod is sectional, and the driving jaws are capable of driving the installation rod in opposite directions.

3. The invention defined in claim 1 wherein the diametrically opposed driving jaws are vertically disposed.

4. The invention defined in claim 1 wherein the pipe installing device is positioned in a narrow operating trench, and stabilizing gates are positioned above the upper driving jaws.

5. The invention defined in claim 1 wherein the operating trench is only approximately six inches wide.

6. The invention defined in claim 1 wherein means are provided to insure that precise equal pressures are exerted on the installation rod by the jaws comprising motion transmitting means carried by the jaws to insure equal movement of the jaws from the position perpendicular to the rod to induce them to grip the installation rod with equal force on opposite sides.

* * * * *